US007999186B2

(12) United States Patent
Sugita

(10) Patent No.: US 7,999,186 B2
(45) Date of Patent: Aug. 16, 2011

(54) LIQUID EJECTING APPARATUS AND SIGNAL TRANSMISSION CHANNEL

(75) Inventor: Hiroshi Sugita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 340 days.

(21) Appl. No.: 12/154,481

(22) Filed: May 23, 2008

(65) Prior Publication Data

US 2008/0309425 A1 Dec. 18, 2008

(30) Foreign Application Priority Data

May 25, 2007 (JP) ..... 2007-139350

(51) Int. Cl.
*H01B 7/00* (2006.01)

(52) U.S. Cl. ..... 174/117 R; 174/117 F; 174/117 FF

(58) Field of Classification Search ..... 174/110 R, 174/113 R, 117 R, 117 F, 117 FF, 36; 347/9
See application file for complete search history.

(56) References Cited

U.S. PATENT DOCUMENTS 3,459,879 A * 8/1969 Gerpheide ..... 174/117 FF
2004/0066425 A1* 4/2004 Togashi et al. ..... 347/9

FOREIGN PATENT DOCUMENTS

JP 2003-112424 A 4/2003
JP 2006-309961 A 11/2006

* cited by examiner

*Primary Examiner* — William H Mayo, III
(74) *Attorney, Agent, or Firm* — Nutter McClennen & Fish LLP; John J. Penny, Jr.

(57) ABSTRACT

A signal transmission channel for a liquid ejecting apparatus having a first cable including a ground line group in which ground lines are lined up continuously and occupies a region of the first cable, and a second cable including a transmission line in which voltage varies, the transmission line being arranged so as to superimpose the region occupied by the ground line group.

13 Claims, 9 Drawing Sheets

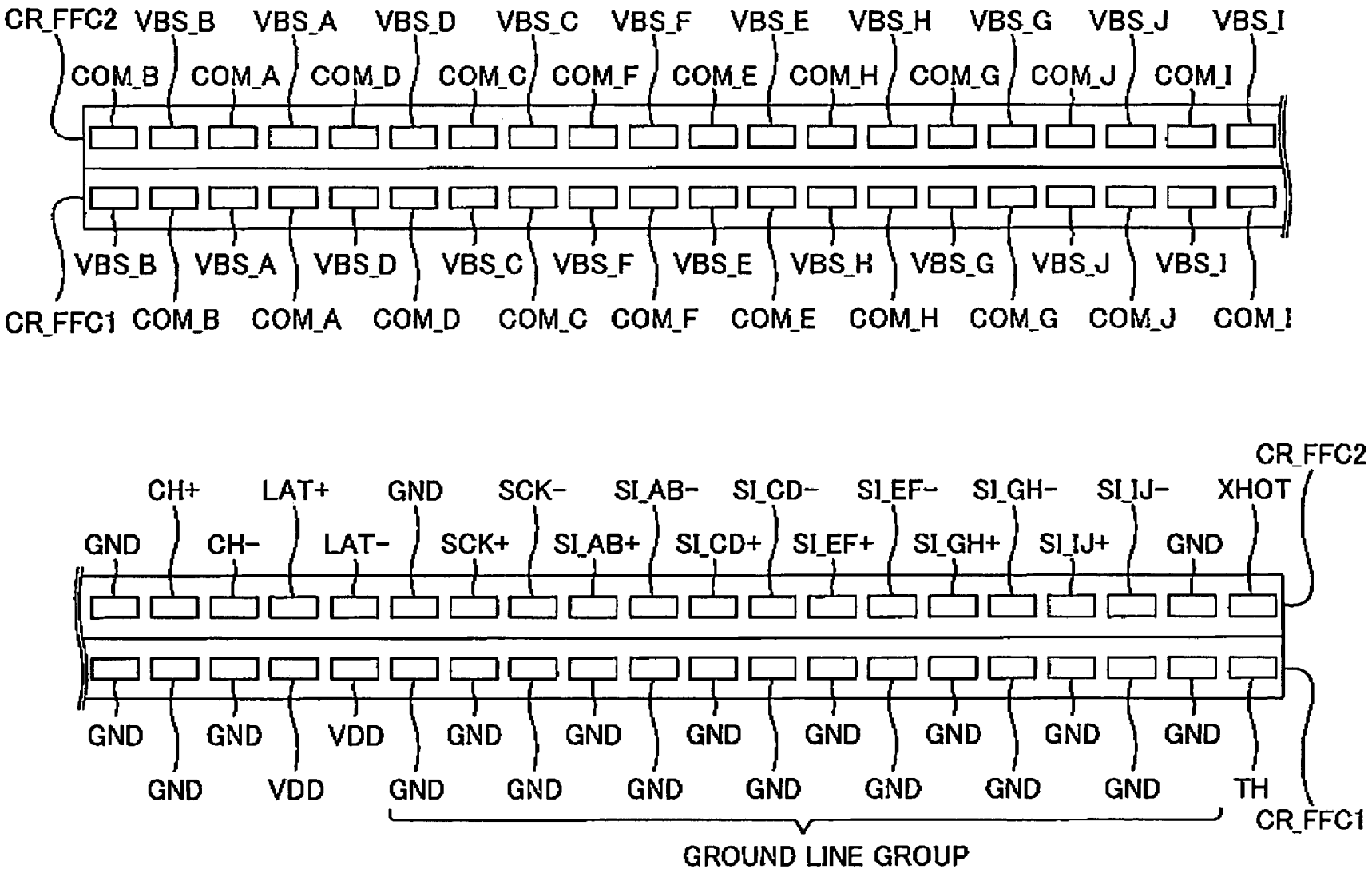
CR_FFC2
VBS_B
VBS_A
VBS_D
VBS_C
VBS_F
VBS_E
VBS_H
VBS_G
VBS_J
VBS_I
COM_B
COM_A
COM_D
COM_C
COM_F
COM_E
COM_H
COM_G
COM_J
COM_I
CR_FFC1
VBS_B
VBS_A
VBS_D
VBS_C
VBS_F
VBS_E
VBS_H
VBS_G
VBS_J
VBS_I
COM_B
COM_A
COM_D
COM_C
COM_F
COM_E
COM_H
COM_G
COM_J
COM_I
CR_FFC2
XHOT
SI_IJ-
SI_IJ+
SI_GH-
SI_GH+
SI_EF-
SI_EF+
SI_CD-
SI_CD+
SI_AB-
SI_AB+
SCK-
SCK+
LAT-
LAT+
CH-
CH+
GND
GND
GND

LIQUID EJECTING APPARATUS AND SIGNAL TRANSMISSION CHANNEL

CROSS-REFERENCE TO RELATED APPLICATIONS

The present application claims priority upon Japanese Patent Application No. 2007-139350 filed on May 25, 2007, which is herein incorporated by reference.

BACKGROUND

1. Technical Field

The present invention relates to liquid ejecting apparatuses and signal transmission channels.

2. Related Art

Signal transmission cables are used for carrying out transmission of signals between circuit boards of electronic devices. Among these cables, flexible flat cables (FFC), in which conducting wires are arranged in a flat manner having a predetermined spacing, are commonly used for reasons such as their thinness and flexibility. And sometimes, in order to increase the packaging density of the transmission lines, a plurality of flexible flat cables having a small number of conducting wires and narrow widths may be used superimposed on each other. (See, for example, JP-A-2003-112424 and JP-A-2006-309961.)

When using flexible flat cables superimposed on each other, ground lines may be arranged at positions in opposition to the transmission lines so as to implement shielding for the signal transmission lines. However, if a relative displacement is caused between the cables for some reason, the position of the ground lines will not be in opposition to the position of the signal transmission line, and a shielding effect may not be achieved satisfactorily.

SUMMARY

The present invention has been devised in light of these circumstances, and it is an advantage thereof to enable a shielding effect to be achieved for transmission lines that transmit signals even when a relative displacement has been caused between superimposed cables.

A primary aspect of the present invention for achieving this advantage involves:

- a first cable that includes a ground line group in which ground lines are lined up continuously in a plurality of transmission lines lined up in a predetermined direction; and
- a second cable that is arranged so as to be in opposition to the first cable and in which a plurality of transmission lines are lined up in the predetermined direction, a transmission line, in which voltage varies, being arranged so as to be in opposition to a region that covers the ground line group.

Other features of the invention other than the above will become clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings wherein:

FIG. 7 is a diagram for describing an arrangement of signal transmission lines in a relaying flexible flat cable CR_FFC;

DESCRIPTION OF EXEMPLARY EMBODIMENTS

Figure 1:
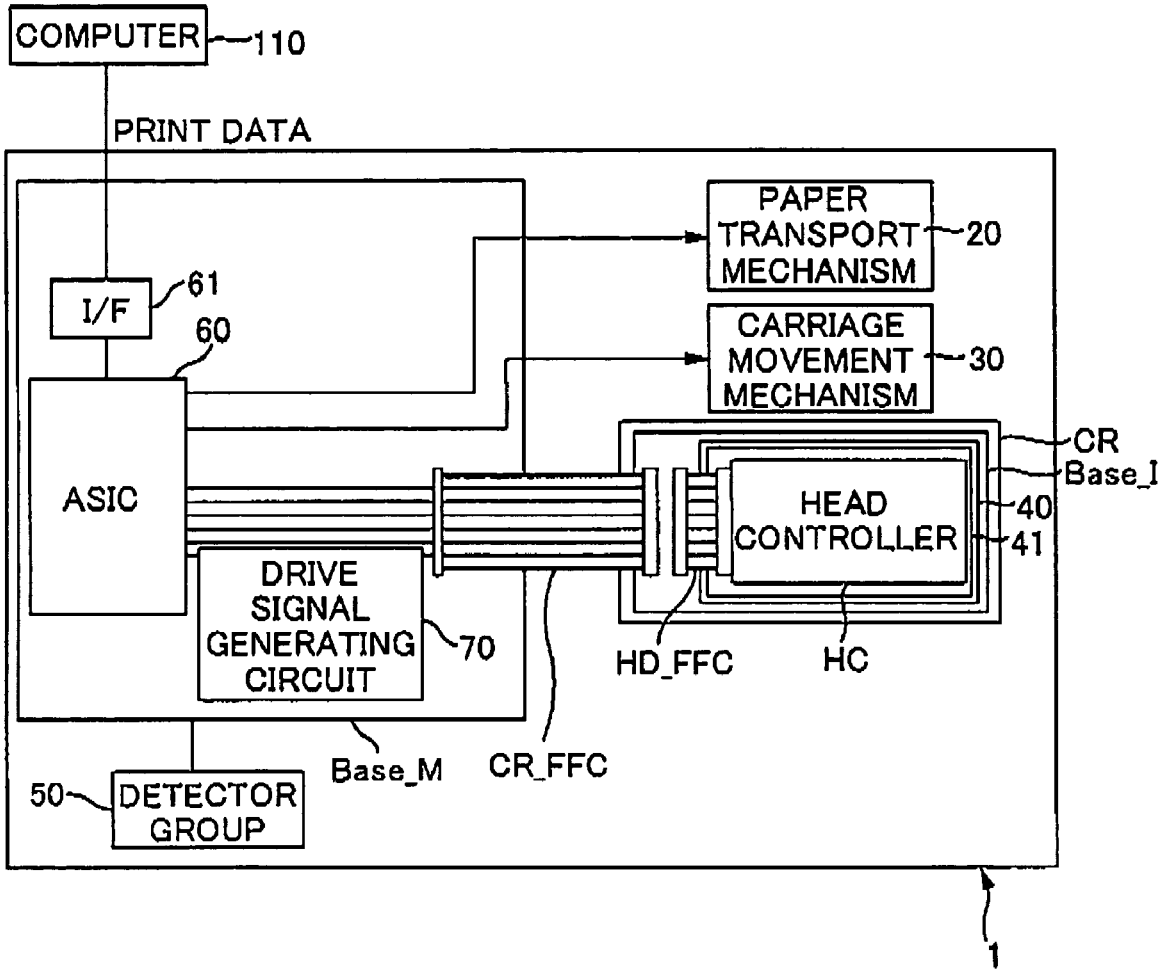
FIG. 1 is a block diagram for describing a configuration of a printer 1.

At least the following matters will be made clear by reading the description of the present specification with reference to the accompanying drawings.

A liquid ejecting apparatus is provided with:

- a first cable that includes a ground line group in which ground lines are lined up continuously in a plurality of transmission lines lined up in a predetermined direction; and
- a second cable that is arranged so as to be in opposition to the first cable and in which a plurality of transmission lines are lined up in the predetermined direction, a transmission line, in which voltage varies, being arranged so as to be in opposition to a region that covers the ground line group.

By configuring in this manner, a shielding effect can be achieved for transmission lines that transmit signals even when a relative displacement has been caused between superimposed cables.

In this liquid ejecting apparatus, it is preferable that the number of the ground lines lined up continuously in the ground line group is at least three lines. Furthermore, it is preferable that the number of the ground lines lined up continuously in the ground line group is at least two lines more than the number of the transmission lines in which voltage varies. Furthermore, it is preferable that, in the second cable, ground lines are further arranged so as to sandwich the transmission line in which voltage varies. Furthermore, it is preferable that a third cable is further provided in opposition to a reverse side of a side of the second cable in opposition to the first cable and which has a ground line group lined up in a predetermined direction, the transmission line, in which voltage varies, in the second cable being arranged so as to be in opposition to a region that covers the ground line group in the third cable.

Furthermore, it is preferable that the transmission line, in which voltage varies, transmits differential signals that are constituted by a signal to be sent and an inverted signal of the signal to be sent. Furthermore, it is preferable that the transmission line, in which voltage varies, transmits a clock signal. Furthermore, it is preferable that a head for ejecting liquid droplets is further provided, wherein the transmission line, in which voltage varies, transmits drive signals to be applied to the head for causing the liquid droplets to be ejected. Furthermore, it is preferable that a head for ejecting liquid droplets is further provided, wherein the transmission line, in which voltage varies, transmits control signals for controlling whether or not to eject the liquid droplets. Furthermore, it is preferable that a first member, which connects one end of the first cable and one end of the second cable, and a second member, which connects another end of the first cable and another end of the second cable, are members that move relative to each other.

Furthermore, it is preferable that a first connecting section, which connects one end of the first cable and one end of the second cable, and a second connecting section, which connects another end of the first cable and another end of the second cable, are connecting sections that do not move relative to each other.

By configuring in this manner, a shielding effect can be achieved for transmission lines that transmit signals even when a relative displacement has been caused between superimposed cables.

A signal transmission channel is provided with:

a first cable including a ground line group in which ground lines are lined up continuously in a plurality of transmission lines lined up in a predetermined direction; and a second cable that is arranged so as to be in opposition to the first cable and in which a plurality of transmission lines are lined up in the predetermined direction, a transmission line, in which voltage varies, being arranged so as to be in opposition to a region that covers the ground line group.

By configuring in this manner, a shielding effect can be achieved for transmission lines that transmit signals even when a relative displacement has been caused between superimposed cables.

First Embodiment

Regarding the Configuration of the Printer 1

Figure 2:
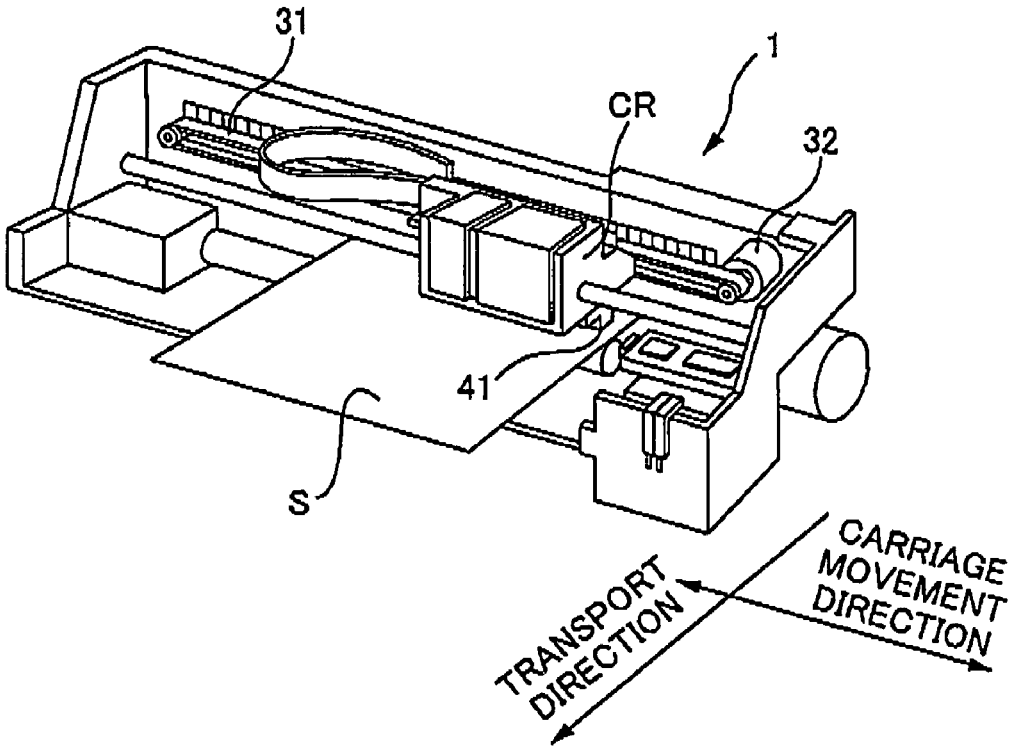
FIG. 2 is a perspective view for describing the printer 1.

FIG. 1 is a block diagram for describing a configuration of a printer 1. FIG. 2 is a perspective view for describing the printer 1. Hereinafter, description is given with reference to these diagrams.

The printer 1 is provided with a paper transport mechanism 20, a carriage movement mechanism 30, a head unit 40 mounted on a carriage CR, a detector group 50, a control circuit 60, an interface 61, and a drive signal generating circuit 70. Moreover, the head unit 40 has a head 41 on which is mounted a head controller HC. The control circuit 60 and the drive signal generating circuit 70 are mounted on a main substrate Base_M that is secured inside the printer 1. A relay substrate Base_I for relaying signals from the main substrate Base_M is mounted on the carriage CR. And the main substrate Base_M and the relay substrate Base_I are connected by a relaying flexible flat cable CR_FFC. Furthermore, the relay substrate Base_I and the head controller HC are connected by a head-connecting flexible flat cable HD_FFC.

The printer 1 carries out printing of an image on a paper S based on print data obtained from a computer 110 via the interface 61. In the printer 1, the paper transport mechanism 20, the carriage movement mechanism 30, the head unit 40, and the drive signal generating circuit 70 are controlled by the control circuit 60. Under the control of the control circuit 60, the paper transport mechanism 20 feeds the paper S up to a printable position, and transports the paper S by a predetermined transport amount in a transport direction. The carriage movement mechanism 30 uses a belt 31 and a carriage motor 32 for movement of the carriage CR and moves the carriage CR, to which the head unit 40 is attached, in a carriage movement direction. Moreover, detectors in the detector group 50 monitor the conditions inside the printer 1. And the detectors output their detection results to the control circuit 60. The control circuit 60 receives the detection results from the detectors, and controls the portions to be controlled based on these detection results. The head unit 40 includes the head controller HC, which includes piezo elements PZT as liquid ejecting sections.

It should be noted that the control circuit 60 includes a storage section storing, for example, waveform data for generating a drive signal, which is discussed below. Furthermore, the control circuit 60 outputs pixel data SI, a latch signal LAT, a change signal CH, and a clock signal SCK for transmission, which are discussed below.

The print data used by the printer 1 is data having a format that can be interpreted by the printer 1, and has various types of command data and pixel data SI. Command data refers to data for instructing the printer 1 to carry out a specific operation. Examples of the command data include command data for directing paper-supply, command data indicating the transport amount, and command data for directing paper-discharge.

The pixel data SI is data relating to the pixels of the image to be printed. Here, the pixels are squares in a virtual grid on the paper, and indicate a region in which a dot is to be formed. The pixel data in the print data is data relating to dots to be formed on the paper (for example, tone values) and is constituted by 2-bit data. That is, the pixel data SI includes a data value [00] corresponding to no dot, a data value [01] corresponding to a small dot, a data value [10] corresponding to the formation of a medium dot, and a data value [11] corresponding to a large dot.

Regarding the Structure of the Head 41

Figure 3:
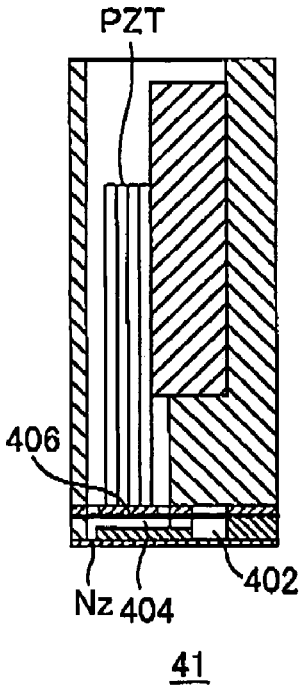
FIG. 3 is a diagram for describing a structure of a head 41.

FIG. 3 is a diagram for describing the structure of the head 41. FIG. 3 shows a nozzle Nz, a piezo element PZT, an ink supply channel 402, a nozzle communicating channel 404, and an elastic panel 406.

In the ink supply channel 402, ink droplets are supplied from an unshown ink tank. Then, these ink droplets or the like are supplied to the nozzle communicating channel 404. A drive pulse of a drive signal COM to be described later is applied to the piezo element PZT. When the drive pulse is applied, the piezo element PZT contracts in accordance with the signal of the drive pulse, and the elastic panel 406 is caused to oscillate. Then, an ink droplet of an amount corresponding to the amplitude of the drive pulse is ejected from the nozzle Nz.

In this manner, 90 groups, each constituted by the nozzle Nz, the piezo element PZT, the ink supply channel 402, the nozzle communicating channel 404, and the elastic panel 406, are lined up in a direction facing the paper plane in FIG. 3, thereby forming a nozzle row. And the head 41 is a head provided with 10 nozzle rows of a first nozzle row A to a tenth nozzle row J.

Regarding the Signals Used in the Head Controller HC

Next, description is given regarding a structure of the head controller HC while also describing the pixel data SI, the clock signal SCK for transmission, the latch signal LAT, and the change signal CH, which are used here.

Figure 4:
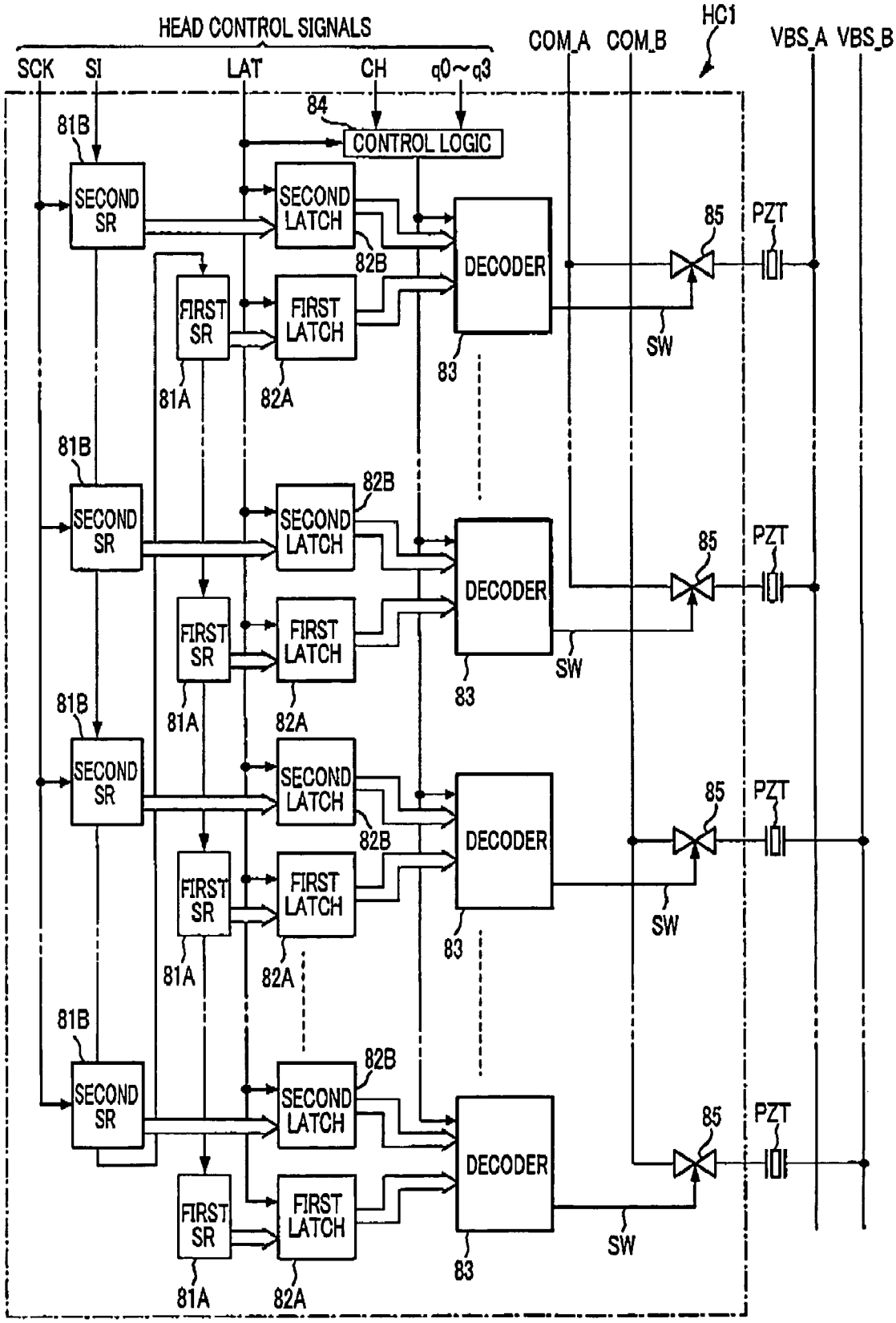
FIG. 4 is a block diagram for describing a configuration of a head controller HC.

FIG. 4 is a block diagram for describing a configuration of the head controller HC. As mentioned above, the head 41 used here has 10 nozzle rows. In the head 41, a head controller HC1 as shown in FIG. 4 is responsible for the ejection of ink from the nozzles of two nozzle rows (when distinguishing and using the head controllers separately, a number is added after the reference symbol "HC" for the head controller, and when referring to head controllers generally, "HC" alone is used as the reference symbol). Since the head 41 has 10 nozzle rows, there are five head controllers HC1 to HC5 mounted on the head 41. Of these, representative description is given here using the configuration of the head controller HC1, which is for ejecting ink droplets from the first nozzle row A and the second nozzle row B. The configurations of the head controllers HC2 to HC5, which are for ejecting ink droplets from the third nozzle row C to the tenth nozzle row J, are substantially the same configuration as this.

The head controller HC1 is provided with a first shift register 81A, a second shift register 81B, a first latch circuit 82A, a second latch circuit 82B, a decoder 83, a control logic 84, and a switch 85. And sections other than the control logic 84, that is, the first shift register 81A, the second shift register 81B, the first latch circuit 82A, the second latch circuit 82B, the decoder 83, and the switch 85, are provided for each piezo element PZT. And since the piezo element PZT is provided for each nozzle Nz from which ink is ejected, each of these components is therefore provided for each nozzle Nz.

The head controller HC1 carries out control so as to cause ink to be ejected based on pixel data SI_AB from the control circuit 60 (when distinguishing and using separate sets of pixel data of the nozzle rows, the set of pixel data is expressed by adding the reference symbols of the nozzle rows after "pixel data SI," for example, here the pixel data is for the first nozzle row A and the second nozzle row B and therefore this is expressed as "SI-AB". It should be noted that when referring to pixel data generally, "SI" alone is used as the reference symbol). That is, the head controller HC controls the switch 85 based on the print data and selectively applies necessary components in a drive signal COM_A to the piezo elements PZT of the first nozzle row A (when distinguishing and using separate sets of drive signals, the drive signals are expressed by adding the reference symbol of the corresponding nozzle row after the reference symbol of the "drive signal COM," for example, when expressing the drive signal to be applied to the first nozzle row A, this is expressed as drive signal COM_A. On the other hand, when referring to drive signals generally, "drive signal COM" is used). Furthermore, the head controller selectively applies necessary components in a drive signal COM_B to the piezo elements PZT of the second nozzle row B. The drive signals COM are described later.

Here, the pixel data SI_AB is constituted by two bits, and is delivered to the head controller HC in synchronization with the clock signal SCK for transmission. The pixel data SI_AB is constituted by two bits and is determined for each nozzle Nz (for each piezo element PZT). In relation to the pixel data SI_AB, an upper-bit group is set in the first shift registers 81A, and a lower-bit group is set in the second shift registers 81B. The first shift registers 81A are connected to the first latch circuits 82A, and the second shift registers 81B are connected to the second latch circuits 82B. When the latch signal LAT from the control circuit 60 becomes high (H) level, the first latch circuit 82A latches the upper bit of the corresponding pixel data SI_AB and the second latch circuit 82B latches the lower bit of the pixel data SI_AB. Each set of pixel data SI_AB that has been latched by the first latch circuit 82A and the second latch circuit 82B (the pair of the upper bit and the lower bit) is input to the decoder 83.

The decoder 83 performs a decoding operation based on the upper bit and the lower bit of the pixel data SI_AB, and outputs switch control signals SW for controlling the switches 85. Based on the pixel data SI_AB, the decoder 83 selects selection data q0 to q3 outputted from the control logic 84 and outputs these as the switch control signal SW. Furthermore, the control logic 84 outputs the selection data q0 to q3 with timings of the latch signal LAT and the change signal CH. Here, the selection data q0 is selection data for no dot. That is, the selection data q0 is selection data of the switch control signal SW in the case where no dot is to be formed on the paper S. The selection data q1 is selection data for a small dot. That is, the selection data q1 is selection data of the switch control signal SW in the case where a small dot is to be formed on the paper S. Similarly, the selection data q2 is selection data for a medium dot, and the selection data q3 is selection data for a large dot. And the control logic 84 outputs the selection data q0 to q3 at the same time through different signal lines.

The switch control signals SW that are outputted from the decoders 83 are inputted to the switches 85. The switches 85 are switches that turn on and off in response to the switch control signal SW, and apply the drive signal COM_A or COM_B to the piezo elements PZT during the on period. That is, the drive signal COM_A or COM_B from the drive signal generating circuit 70 is applied to the input side of the switches 85, and the piezo elements PZT are connected to the output side of the switches 85. Then, when the switch control signal SW is the data value [1] (H level), then the switch 85 becomes on and the drive signal COM_A or COM_B is applied to the piezo element PZT. And if the switch control signal SW is the data value [0] (L level), then the switch 85 becomes off, and therefore the drive signal COM_A or COM_B is not applied to the piezo element PZT. It should be noted that a bias voltage VBS_A or VBS_B is applied to the shared electrode side of the piezo elements PZT (here also, when distinguishing and using separate sets of bias voltages, the bias voltages are expressed by adding the reference symbol of the corresponding nozzle row after the reference symbol of the "bias voltage VBS," and when referring to bias voltages generally, "VBS" is used as the reference symbol).

The bias voltage VBS applies a constant voltage to the shared electrode sides of the piezo elements. If no drive signal was generated due to some reason, the voltage applied to the piezo elements would suddenly drop from the voltage of the drive signal to 0 (V). If this happened, the piezo elements PZT would rapidly undergo displacement and there is a risk that ink droplets would be ejected inadvertently. Thus, if a constant voltage is applied to the shared electrode sides, it is possible to prevent the voltage from dropping rapidly to 0 (V) even when no drive signal is generated due to some reason. And it is possible to prevent ink from being ejected inadvertently. It should be noted that the bias voltages used are matched to the drive signals respectively. As mentioned earlier, there are 10 kinds of drive signals. Accordingly, 10 kinds of bias voltages are prepared, these being VBS_A to VBS_J.

Among the above-described signals, the clock signal SCK for transmission is one of the fastest transmitted signals of the pulse signals used in ink ejection control of the printer 1. Accordingly, it is prone to becoming a noise source for the other signals. Furthermore, since it is a high frequency signal, it is easily affected by noise from other signals. Accordingly, shielding is preferably implemented for the transmission line of the clock signal SCK for transmission.

Furthermore, the pixel data SI is important data for indicating what size of ink droplet is to be ejected from the nozzles. Supposing the pixel data SI were to be adversely affected by noise from other signals, it would not be possible to form a proper image. Accordingly, shielding is preferably implemented also for the transmission line of the pixel data SI.

Regarding the Drive Signals COM

Figure 5:
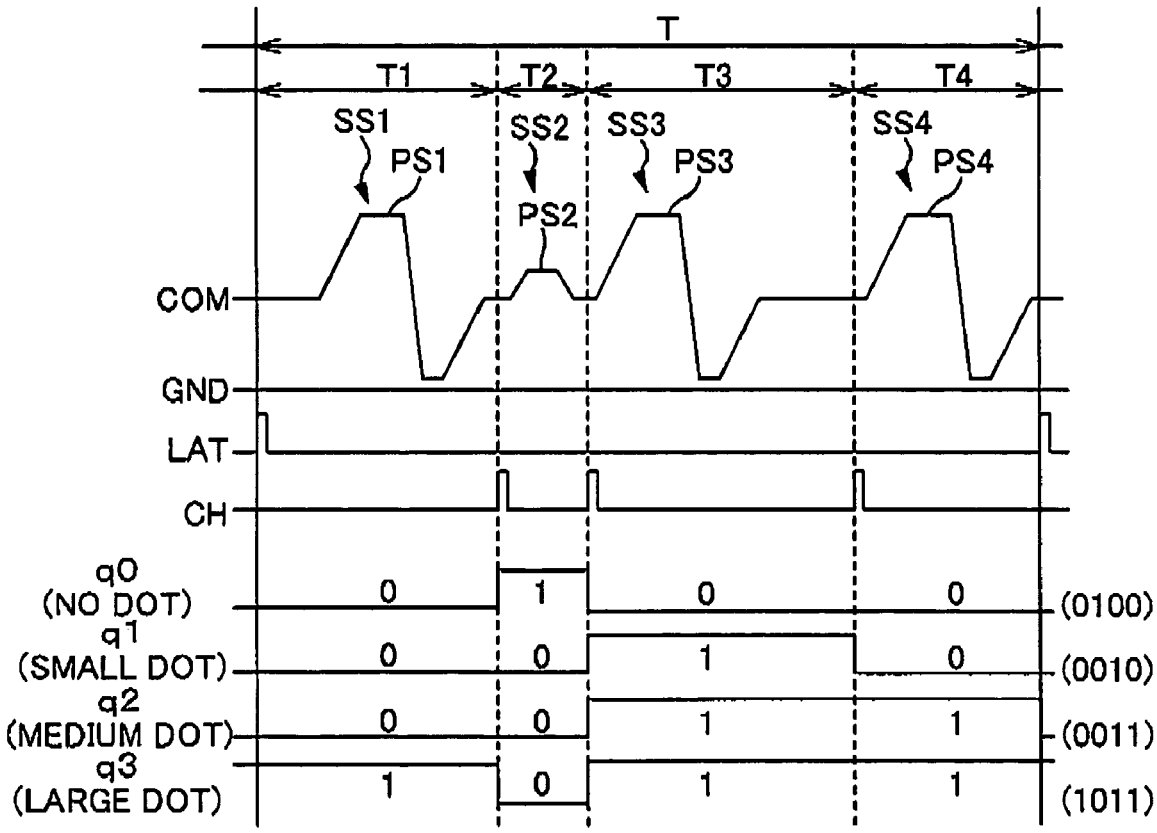
FIG. 5 is a diagram for describing a drive signal COM that is generated by a drive signal generating circuit 70 and a control signal that is used during the formation of dots.

FIG. 5 is a diagram illustrating the drive signal COM that is generated by the drive signal generating circuit 70 and a control signal that is used during the formation of dots. As mentioned earlier, 10 kinds of drive signals (COM_A to COM_J) are used and since these drive signals have substantially the same function, description is given here using drive signal COM as a general representative term.

As shown in FIG. 5, the drive signal COM is generated in a period T as a single unit that is marked by the timings of the rising edges of the latch signal LAT. The period T includes time sections T1 to T4 marked by the timings of the rising edges of the latch signal LAT or the change signal CH. Furthermore, the time sections T1 to T4 include drive pulses respectively, which are described later.

The period T, which is a repetitive cycle, corresponds to a period of a time in which the nozzles move by a one pixel portion. For example, in a case of printing with a resolution of 720 dpi, the period T corresponds to a period for moving the nozzle by 1/720 inch. And a certain number of ink droplets are ejected within a single pixel by applying the drive pulses PS1 to P54 of each time section contained in the period T to the piezo element PZT based on the pixel data SI, thereby enabling a plurality of tones to be expressed.

The drive signal COM includes a first waveform portion SS1 that is generated in the time section T1, a second waveform portion SS2 that is generated in the time section T2, a third waveform portion SS3 that is generated in the time section T3, and a fourth waveform portion SS4 that is generated in the time section T4 during the repetitive cycle. Here, the first waveform portion SS1 includes the drive pulse PS1. And the second waveform portion SS2 includes the drive pulse PS2, the third waveform portion SS3 includes the drive pulse PS3, and the fourth waveform portion SS4 includes the drive pulse PS4.

The drive pulse PS1, the drive pulse PS3, and the drive pulse PS4 are used when ejecting ink from the nozzles Nz, and all have the same waveform. Here, the drive pulse PS3 is applied to the piezo element PZT when forming a small dot. And when forming a medium dot, the drive pulse PS3 and the drive pulse PS4 are applied to the piezo element PZT, and when forming a large dot, the drive pulse PS1, the drive pulse PS3, and the drive pulse PS4 are applied to the piezo element PZT. The drive pulse P52 is a micro-vibration pulse for causing micro-vibration in a meniscus, and is applied to the piezo element PZT in the case where no dot is to be formed.

In order to carry out control in this manner, the selection data q0 to q3 is constituted by 4-bit data, with each bit made to correspond to the time sections T1 to T4 respectively. And the most significant bit of the selection data q0 to q3 indicates on/off of the first switch 85A in the time section T1, and the second bit indicates on/off of the first switch 85A in the time section T2. Similarly, the third bit indicates on/off of the first switch 85A in the time section T3, and the least significant bit indicates on/off of the first switch 85A in the time section T4. Consequently, the selection data q0 for no dot is set to [0100] and the selection data q1 for a small dot is set to [0010]. Similarly, the selection data q2 for a medium dot is set to [001] and the selection data q3 for a large dot is set to [1011]. And the control logic 84 outputs each bit of the selection data q0 to q3 in a time series synchronized with timings prescribed by the latch pulse of the latch signal LAT and the change pulse of the change signal CH.

The drive signals COM require power to drive 90 piezo elements PZT, and therefore these are signals having a large electric current compared to the other signals. Thus, they can be considered as signals that are prone to affect as noise the other signals that flow through the flexible flat cable. Accordingly, shielding is preferably implemented also for the transmission line drive signal COM.

Other Signals Traveling on the Flexible Flat Cable

Here description is given regarding other signals that travel via the relaying flexible flat cable CR_FFC or the head-connecting flexible flat cable HD_FFC.

A temperature signal TN is a signal for sending temperature information obtained by an unshown temperature measuring instrument attached to the head 41. With the temperature signal TH, temperature information of the head 41 is sent to the main substrate Base_M. In this manner, the temperature signal TH is a signal for sending temperature information and is sent less frequently compared to the aforementioned pixel data SI or the like.

An abnormal heating notification signal XHOT is a signal sent from an unshown abnormal heating alarm attached to the head 41. When the head reaches a predetermined temperature or higher, this signal notifies the main substrate Base_M of the temperature abnormality. The abnormal heating notification signal XHOT is almost never outputted and the frequency of its usage is extremely small.

A first power source VDD is a power source for supplying power to the head controller HC from the main substrate Base_M via the relay substrate Base_I. Furthermore, a second power source VDD2 is a power source for supplying power from the main substrate Base_M to the relay substrate Base_I. The first power source VDD and the second power source VDD2 are constant voltage power sources.

Differential Signals

Figure 6A:
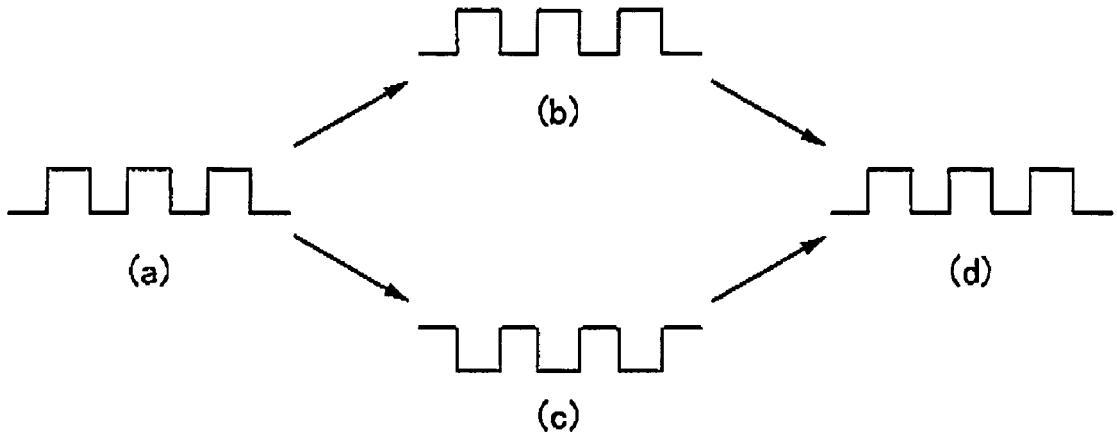
FIG. 6A is a diagram for describing differential signals.

FIG. 6A is a diagram for describing differential signals. In sending differential signals, the signal intended to be sent is sent as a positive differential signal and the signal intended to be sent is further sent by generating an inverted signal. Here, the signal intended to be sent is set as a positive differential signal and the inverted signal of the signal intended to be sent is set as a negative differential signal. In FIG. 6A, (a) indicates the signal intended to be sent, (b) indicates the positive differential signal, and (c) indicates the negative differential signal.

Then, after these differential signals are sent via the flexible flat cable, the original signal (the signal intended to be sent) is restored using the positive differential signal and the negative differential signal. Restoring to the original signal is carried out by subtracting the voltage of the negative differential signal from the voltage of the positive differential signal, then halving this voltage value ((d)).

Figure 6B:
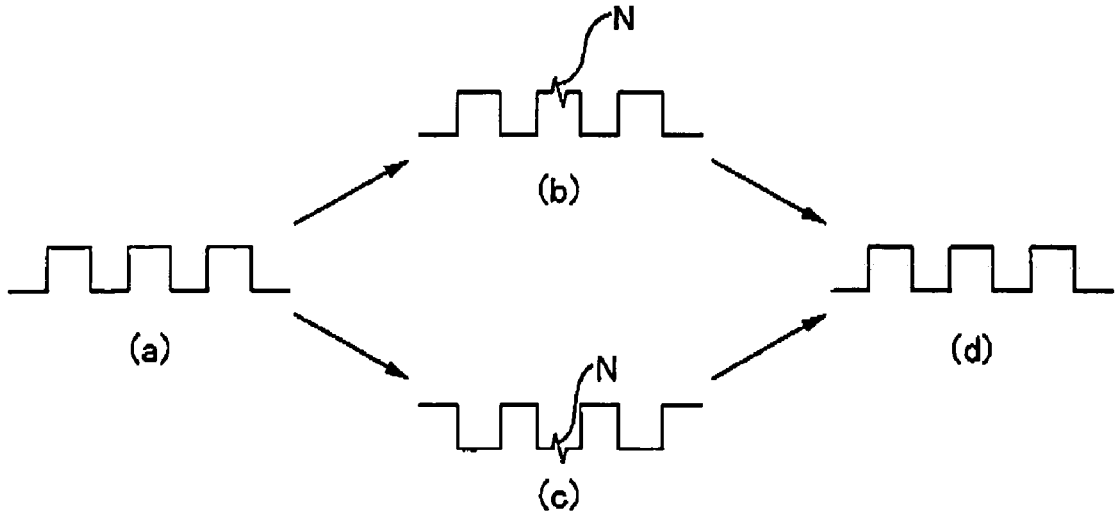
FIG. 6B is a diagram for describing differential signals when noise is introduced during sending of the signals.

FIG. 6B is a diagram for describing differential signals when noise is introduced during sending of the signals. Here, a positive differential signal ((b)) and a negative differential signal ((c)) are generated and sent via the cable in a same manner as in FIG. 6A. Suppose that when the signals are sent via the cable, a certain noise N is introduced. Since the positive differential signal and the negative differential signal are transmitted via the same cable, substantially the same noise is introduced.

However, when the original signal is restored using the positive differential signal and the negative differential signal according to the above-described procedure, the noise that was introduced to both of these in a similar manner is offset by the aforementioned process of subtracting voltage values ((d)). By using differential signals in this way, the original signal intended to be sent can be restored even when noise is introduced during transmission of the signals.

Since noise is removed in this manner, it is preferable that noise of the same waveform is introduced to the positive differential signal and the negative differential signal. Furthermore, since the original signal is restored using the positive differential signal and the negative differential signal, it is preferable that the transmission distances for both of these are equivalent and that there is no relative delay in the signal arrival for either of these. Accordingly, it is preferable that the transmission lines of the positive differential signal and the negative differential signal are in close positions in the flexible flat cable.

It should be noted that hereinafter when indicating a differential signal using a reference symbol, "+" is appended to the positive differential signal of the differential signal and "−" is appended to the negative differential signal. For example, when the pixel data SI is to be sent using differential signals, the positive differential signal of the pixel data SI is "SI+" and the negative differential signal is "SI−."

Arrangement of Signal Transmission Lines

FIG. 7 is a diagram for describing an arrangement of signal transmission lines in the relaying flexible flat cable CR_FFC.

The relaying flexible flat cable CR_FFC is constituted by a first relaying flexible flat cable CR_FFC1 and a second relaying flexible flat cable CR_FFC2 superimposed on each other. In FIG. 7, the two flexible flat cables are shown divided for convenience of illustration on paper but these are continuous. Furthermore, FIG. 7 shows a state in which these two flexible flat cables are arranged superimposed on each other. In FIG. 7, the two flexible flat cables are superimposed so as to be in contact with each other, but the two flexible flat cables are not adhered to each other and the flexible flat cables may be apart from each other. It should be noted that the first relaying flexible flat cable CR_FFC1 corresponds to a first cable and the second relaying flexible flat cable CR_FFC2 corresponds to a second cable.

In the first relaying flexible flat cable CR_FFC1, a total of 20 lines of bias voltage VBS transmission lines and drive signal COM transmission lines are lined up alternately from the left in FIG. 7. And three ground lines GND are lined up to the right of the drive signal COM_I transmission line. Further to the right, two lines of the first power source VDD transmission lines are lined up. Then 14 lines of ground lines are lined up as a ground line group. A transmission line for the temperature signal TH is arranged to the right of the ground line group.

In the second relaying flexible flat cable CR_FFC2, a total of 20 lines of drive signal COM transmission lines and bias voltage VBS transmission lines are lined up so as to be alternating from the left in FIG. 7. And one ground line GND is lined up to the right of the bias voltage VBS_I. Further to the right, transmission lines of differential signals for the change signal CH, the latch signal LAT, the clock signal SCK for transmission, and the pixel data SI_AB, SI_CD, SI_EF, SI_GH, and SI_IJ are lined up. And to the right of this, a ground line GND and an abnormal heating notification signal XHOT transmission line are lined up.

By doing this, the transmission lines of the pixel data SI and the transmission lines of the clock signal SCK for transmission are arranged so as to be in opposition to a region that is covered by the ground line group. Furthermore, two more ground lines are set in the ground line group than the 12 transmission lines for the clock signal SCK for transmission and the pixel data SI. Accordingly, even if the relative positions of the first relaying flexible flat cable CR_FFC1 and the second relaying flexible flat cable CR_FFC2 become displaced within a range equivalent to a single transmission line, the transmission lines of the clock signal SCK for transmission and the transmission lines for the pixel data SI are positioned at a position in opposition to the region that is covered by the ground line group. The ground line group, which is constituted by ground lines lined up continuously, shields electromagnetic waves from the transmission lines that are in opposition to the region covering the ground line group. Thus, an excellent shielding effect for these transmission lines can be achieved.

Here, the first relaying flexible flat cable CR_FFC1 and the second relaying flexible flat cable are used superimposed on each other to connect the main substrate Base_M and the relay substrate Base_I. The relay substrate Base_I moves relative to the main substrate Base_M. And when this happens, along with the movement of the relay substrate Base_I, the superimposed flexible flat cables sometimes become displaced in the direction in which their transmission lines are lined up. Even in a case such as this, by using the above-described configuration, an excellent shielding effect can be achieved for the transmission lines in which voltages vary.

In particular, in a case of large size printers or the like, the movement distance of the carriage CR is long and the length of the flexible flat cables becomes longer. When this happens, the signals traveling on the transmission lines become noise and there is a high possibility that they will have an adverse effect on other signals. Furthermore, there is a high possibility that the superimposed flexible flat cables will become displaced in the direction in which their signal lines line up during movement of the carriage CR. Even in a case such as this, an excellent shielding effect can be achieved for the transmission lines in which voltages vary as described above.

Furthermore, ground lines GND are arranged to the left of the transmission line for the clock signal SCK for transmission and to the right of the transmission lines for the pixel data SI_IJ. Accordingly, the shielding effect for the transmission lines of the clock signal SCK for transmission and the pixel data SI can be further increased.

Figure 8:
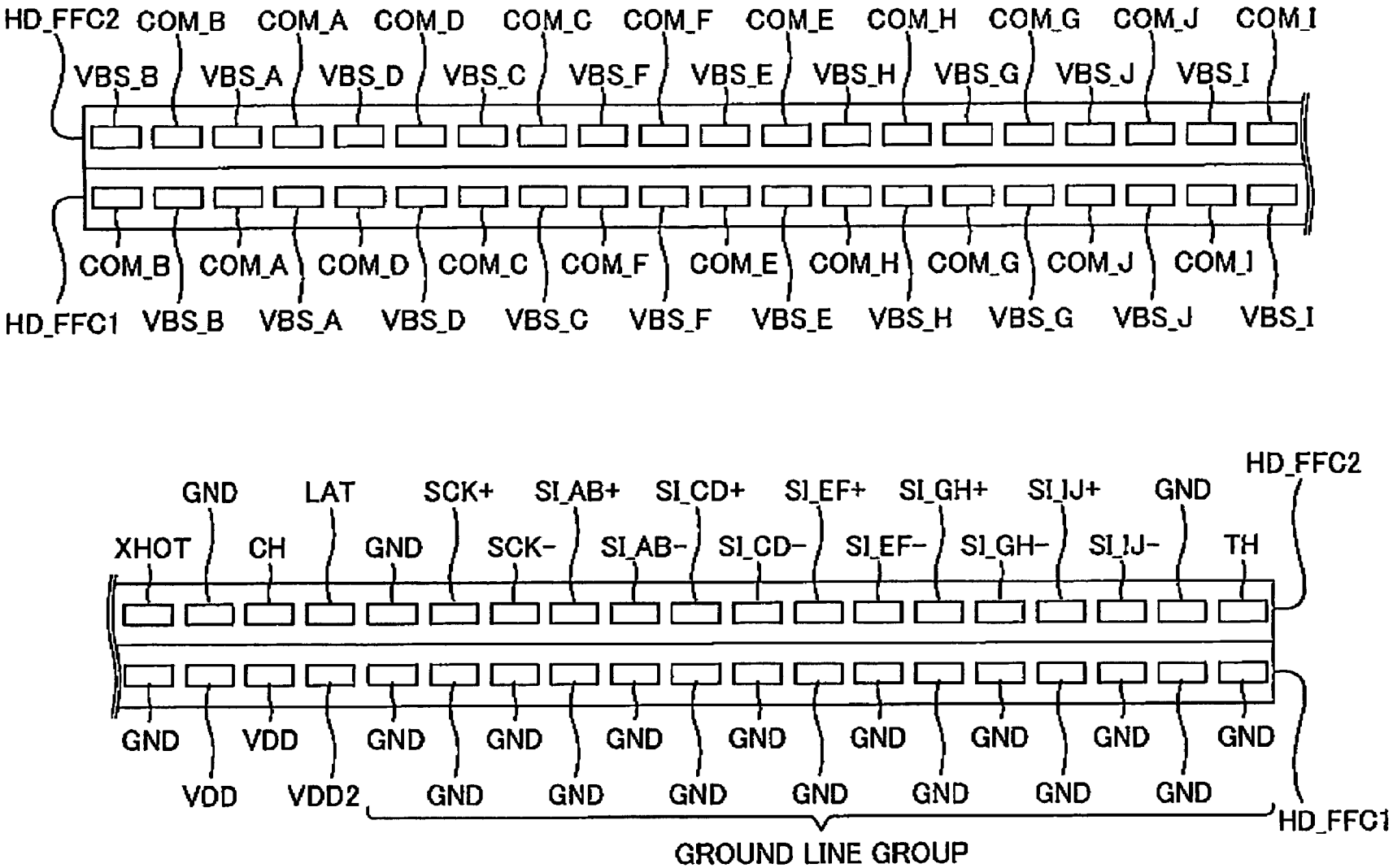
FIG. 8 is a diagram for describing an arrangement of signal transmission lines in a head-connecting flexible flat cable HD_FFC.

FIG. 8 is a diagram for describing an arrangement of signal transmission lines in the head-connecting flexible flat cable HD_FFC.

The head-connecting flexible flat cable HD_FFC is constituted by a first head-connecting flexible flat cable HD_FFC1 and a second head-connecting flexible flat cable HD_FFC2 superimposed on each other. In FIG. 8, the two flexible flat cables are shown divided for convenience of illustration on paper but these are continuous. Furthermore, FIG. 8 shows a state in which these two flexible flat cables are arranged superimposed on each other. In FIG. 8, the two flexible flat cables are superimposed so as to be in contact with each other, but the two flexible flat cables are not adhered to each other and the flexible flat cables may be apart from each other. It should be noted that in this case the first head-connecting flexible flat cable HD_FFC1 corresponds to a first cable and the second head-connecting flexible flat cable HD_FFC2 corresponds to a second cable.

In the first head-connecting flexible flat cable HD_FFC1, a total of 20 lines of drive signal COM transmission lines and bias voltage VBS transmission lines are lined up so as to be alternating from the left in FIG. 8. And a ground line GND is lined up to the right of the transmission line for the bias voltage VBS_I, And lined up further to the right are two lines of the first power source VDD transmission lines and one line of the second power source VDD2 transmission line. Then 15 lines of ground lines are lined up as a ground line group.

In the second head-connecting flexible flat cable HD_FFC2, a total of 20 lines of bias voltage VBS transmission lines and drive signal COM transmission lines are lined up alternately from the left in FIG. 8. And an abnormal heating notification signal XHOT transmission line is lined up to the right of the drive signal COM_I transmission line. To the right of this, a ground line GND, a change signal CH, and a latch signal LAT are lined up. And to the right of this is lined up one ground line GND. Further to the right, transmission lines of differential signals for the clock signal SCK for transmission and the pixel data SI_AB, SI_CD, SI_EF, SI_GH, and SI_IJ are lined up. And to the right of this, a ground line GND and a temperature signal TH transmission line are lined up.

Here also, the transmission lines of the pixel data SI and the transmission lines of the clock signal SCK for transmission are arranged so as to be in opposition to a region that covers the ground line group. Furthermore, two or more ground lines are set in the ground line group than the 12 transmission lines for the clock signal SCK for transmission and the pixel data SI. Accordingly, even if the relative positions of the first head-connecting flexible flat cable HD_FFC1 and the second head-connecting flexible flat cable HD_FFC2 become displaced within a range equivalent to a single transmission line, the transmission lines of the clock signal SCK for transmission and the transmission lines for the pixel data SI are positioned at a position in opposition to the region that covers the ground line group. As described earlier, the ground line group, which is constituted by ground lines lined up continuously, shields electromagnetic waves from the transmission lines that are in opposition to the region that covers the ground line group. Thus, an excellent shielding effect for these transmission lines can be achieved.

Furthermore, ground lines GND are arranged to the left of the transmission line for the clock signal SCK for transmission and to the right of the transmission lines for the pixel data SI_IJ. Accordingly, the shielding effect for the transmission lines of the clock signal SCK for transmission and the pixel data SI can be further increased.

The first head-connecting flexible flat cable HD_FFC1 and the second head-connecting flexible flat cable HD_FFC2 are used superimposed on each other to connect the relay substrate Base_I and the head controller HC. Although the relay substrate Base_I and the head controller HC do not move relative to each other, a case is possible where the superimposed flexible flat cables are assembled displaced in the direction of their transmission lines during a manufacturing process of the printer. However, with the above-described configuration, a ground line group constituted by at least three ground lines is lined so as to be in opposition to the signal lines having voltage variation. Thus, even when the flexible flat cables become displaced within a range equivalent to one transmission line in the direction in which the transmission lines are lined up during a manufacturing process of the printer, they can be set such that the transmission lines of noise-source signals are in opposition to the region that covers the ground line group.

Also, a configuration of two flexible flat cables such as the above-described can also be used for connections between a head of a line head printer, where the head is lined up in a paper width direction of the paper, and the controller substrate. Although the head and the controller substrate do not move relative to each other in a line head printer, a case is possible where the superimposed flexible flat cables are assembled displaced in the direction of their transmission lines during a manufacturing process of the printer. In a case such as this, even when the flexible flat cables are undesirably assembled relatively displaced within a range equivalent to one transmission line in the direction in which the transmission lines are lined up during a manufacturing process of the printer, they can be set such that the transmission lines of noise-source signals are in opposition to the region that covers the ground line group.

Furthermore, in a line head printer where the heads are lined up in the paper width direction of the paper, a large number of signals have to be used since there is a large number of heads. Accordingly, there may be a case where more flexible flat cables are used further superimposed on each other, and if the ground lines are lined up as in the above-described embodiment in a case such as this, shielding can be achieved efficiently for the transmission lines in which voltages vary.

Furthermore, here the transmission lines of the clock signal SCK for transmission and the transmission lines of the pixel data SI are arranged so as to be in opposition to the region that covers the ground line group, but it is also possible to arrange this such that the transmission lines of the drive signal COM are in opposition to the region that covers the ground line group. The amount of electric current for the drive signal COM is a larger amount of electric current compared to other signals that travel in the flexible flat cables and presents a risk as a noise source, but by configuring in this manner, the effect on other signals can be lessened.

Furthermore, here, the positive differential signal and the negative differential signal are arranged to so as to be lined up continuously. This is because it is desirable to not produce any relative delay in the signal arrival for either of these by ensuring as much as possible that the transmission distances for the positive differential signal and the negative differential signal are equivalent. Also, it is considered that by arranging these lined up in close positions, even supposing that noise affects these signals, they will be affected by noise of substantially the same form. Since same-form noises are offset against each other in differential signals, it is preferable to arrange these lines in positions as close as possible so that even when noise is introduced, it is the same noise that is introduced.

In the above-described embodiment, transmission lines in which voltages vary are arranged so as to be in opposition to the region that covers the ground line group, but a simpler embodiment where transmission lines in which voltages vary are arranged so as to be in opposition to the region that covers the ground line group is as follows.

Figure 9A:
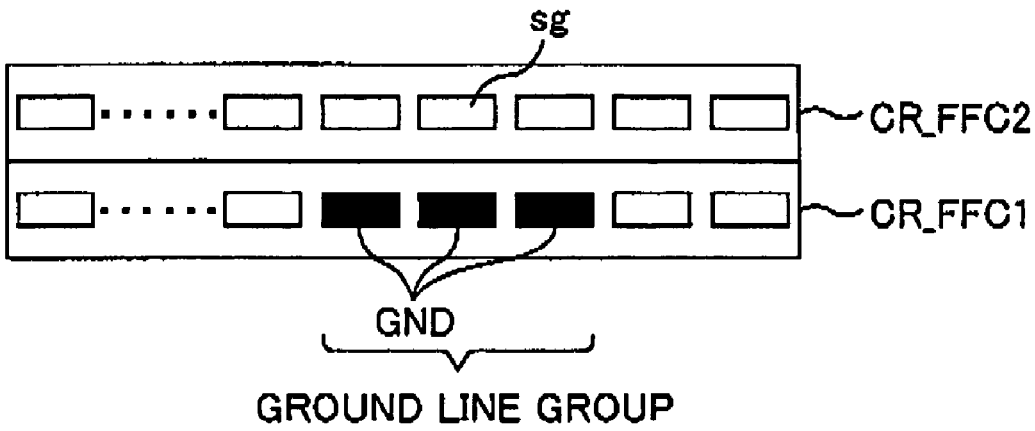
FIG. 9A is a diagram for describing a condition in which three ground lines are in opposition to a transmission line in which voltage varies.

FIG. 9A is a diagram for describing a condition in which three ground lines are in opposition to a transmission line in which voltage varies. Furthermore, FIG. 9B is a diagram for describing a condition when ground lines are displaced by approximately one line portion with respect to a transmission line in which voltage varies.

In FIG. 9A, a single transmission line sg in which voltage varies is positioned so as to be in opposition to a center of a ground line group constituted by three ground lines lined up. Here, the transmission line sg in which voltage varies is a transmission line of the clock signal SCK for transmission, a transmission line of the pixel data SI, or a transmission line of the drive signal COM, and is a transmission line for which shielding is preferable.

Figure 9B:
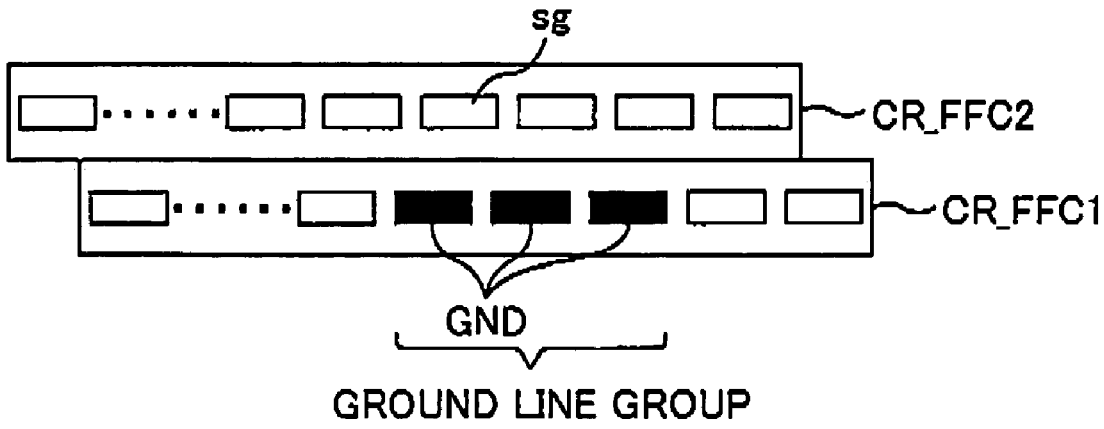
FIG. 9B is a diagram for describing a condition when ground lines are displaced by approximately one transmission line portion with respect to a transmission line in which voltage varies.

FIG. 9B shows a case where, due to some reason, the transmission line sg in which voltage varies has become displaced with respect to the ground line group within a range equivalent to a single transmission line. In FIG. 9A the single transmission line sg in which voltage varies is arranged so as to be in opposition to the center of the ground line group. Accordingly, even in a case where the ground line group has become displaced with respect to the transmission line sg in which voltage varies within a range equivalent to a single transmission line, the transmission line sg in which voltage varies is positioned in a position in opposition to the region that covers the ground line group. The ground line group, which is constituted by ground lines lined up continuously, shields electromagnetic waves from the transmission line that is in opposition to the region that covers the ground line group. Thus, by configuring in this manner, an excellent shielding effect can be achieved for the transmission line sg in which voltage varies.

Second Embodiment

Figure 10:
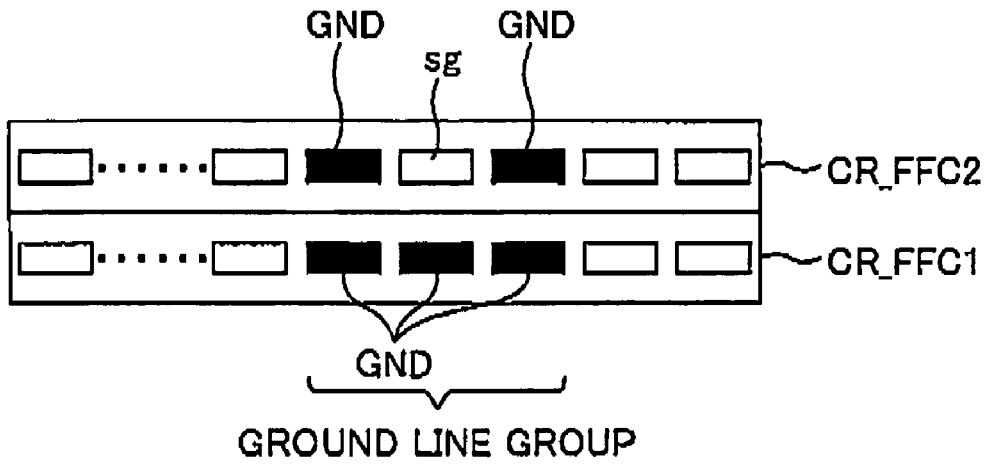
FIG. 10 is a diagram for describing an arrangement of ground lines with respect to a transmission line in which voltage varies according to a second embodiment.

FIG. 10 is a diagram for describing an arrangement of ground lines with respect to a transmission line in which voltage varies according to a second embodiment. Here, the transmission line sg in which voltage varies is arranged so as to be in opposition to a center of three ground lines GND lined up. And a ground line GND is arranged to the left and right of the transmission line in which voltage varies.

In the aforementioned embodiment, ground lines were arranged to the left and right of continuously lined up transmission lines in which voltages vary, thereby arranging the ground lines so as to enclose as a group a plurality of transmission lines in which voltages vary. On the other hand, in the second embodiment, ground lines are arranged so as to enclose a single transmission line in which voltage varies.

In this way, the ground lines GND are arranged so as to enclose the transmission line sg in which voltage varies, and therefore a better shielding effect can be achieved for the single transmission line sg.

Third Embodiment

Figure 11:
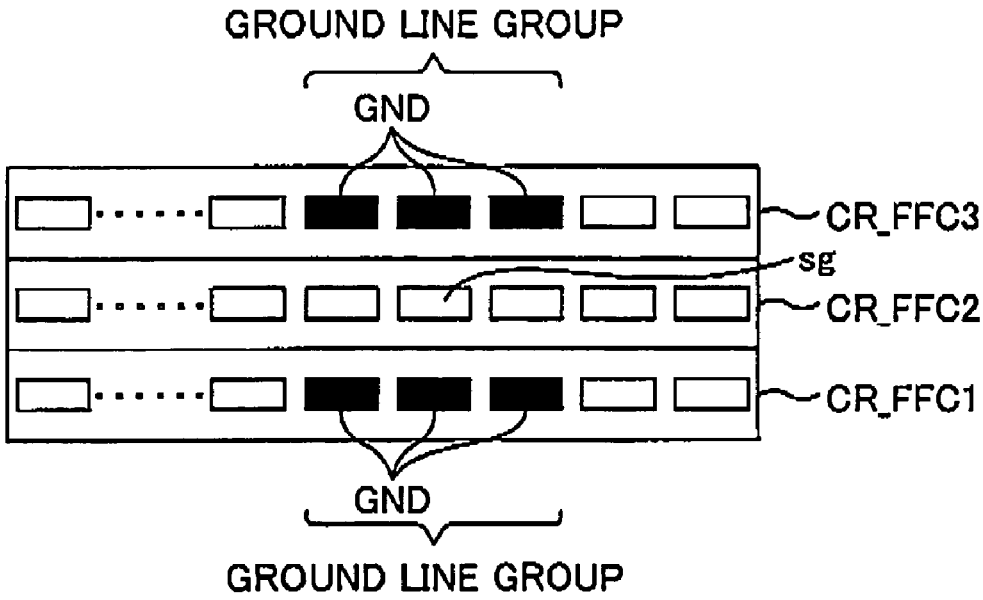
FIG. 11 is a diagram for describing an arrangement of ground lines with respect to a transmission line in which voltage varies according to a third embodiment.

FIG. 11 is a diagram for describing an arrangement of ground lines with respect to a transmission line in which voltage varies according to a third embodiment.

In a case where there is a large number of signals to be transmitted, or a case where it is desired to reduce the width in which transmission lines are lined in a single flexible flat cable, a greater number of flexible flat cables may be used superimposed on each other. In FIG. 11, a transmission line in which voltage varies is shown in a middle flexible flat cable. And two flexible flat cables are shown sandwiching this flexible flat cable, and ground line groups constituted by three ground lines GND respectively are arranged in positions in opposition to a central position of the transmission line sg in which voltage varies.

By configuring in this manner, a better shielding effect can be achieved for the transmission line sg in which voltage varies. Furthermore, in a case where three or more flexible flat cables are superimposed on each other, the ground lines can be arranged efficiently while achieving an excellent shielding effect for the transmission line sg in which voltage varies.

Other Embodiments

The aforementioned embodiments were described mainly using an example of a small-type printer 1, but the aforementioned techniques can also be applied to a large-type printer having a wide paper width and a large movement range of the carriage CR. In a case where the movement range of the carriage CR is large in this manner, the superimposed flexible flat cables may become relatively displaced from each other during movement of the carriage CR, but even in this case, a shielding effect can be achieved for the transmission line in which voltage varies by applying the aforementioned techniques.

Furthermore, as mentioned earlier, the aforementioned techniques may be applied to a line head printer in which a large number of heads are arranged lined up in the paper width direction. In line head printers, a large number of signals have to be transmitted due to the large number of heads, and there is a tendency for there to be many transmission lines. When this happens, a greater number of flexible flat cables may be used superimposed on each other. And then the flexible flat cables may become relatively displaced from each other. However, by applying the aforementioned techniques, the ground lines can be arranged with excellent efficiency while achieving a shielding effect for the transmission line in which voltage varies.

Furthermore, the above-described techniques are applicable to various industrial devices other than printing methods in which printing is carried out by ejecting ink onto paper or the like. Major examples of these include textile apparatuses (methods) for applying a pattern to a fabric, circuit board manufacturing apparatuses (methods) for forming circuit patterns on circuit boards, DNA chip manufacturing apparatuses (methods) for manufacturing DNA chips by applying a solution in which DNA is dissolved onto a chip, and apparatuses (methods) for manufacturing displays such as organic EL displays.

The foregoing embodiments are merely for facilitating the understanding of the invention and are not meant to be interpreted in a manner limiting the scope of the invention. The invention can of course be altered and improved without departing from the gist thereof and includes functional equivalents. In particular, embodiments described below are also included in the invention.

Regarding the Head

In the foregoing embodiments, ink was ejected using piezoelectric elements. However, the method for ejecting liquid is not limited to this. Other methods, such as a method for generating bubbles in the nozzles through heat, may also be employed.

Conclusion (1) The printer 1 according to the aforementioned embodiments includes a first relaying flexible flat cable CR_FFC1 (or a first head-connecting flexible flat cable HD F_C1) and a second relaying flexible flat cable CR_FFC2 (or a second head-connecting flexible flat cable HD_FFC2). The first relaying flexible flat cable CR_FFC1 includes a ground line group in which ground lines are lined up continuously in a plurality of transmission lines lined up in a predetermined direction. The second relaying flexible flat cable CR_FFC2 is arranged in opposition to the first relaying flexible flat cable CR_FFC1 and has a plurality of transmission lines lined up in the predetermined direction. And the transmission lines in which voltages vary are arranged so as to be in opposition to a region that is covered by the aforementioned ground line group.

By doing this, even if the relative positions of the first relaying flexible flat cable CR_FFC1 and the second relaying flexible flat cable CR_FFC2 become displaced in the direction in which the transmission lines are lined up, the transmission lines (SCK, SI, and COM in the foregoing embodiments) in which voltages vary can be positioned so as to be in opposition to the region that covers the ground line group. The ground line group, which is constituted by ground lines lined up continuously, shields electromagnetic waves from the transmission lines that are in opposition to the region covered by the ground line group. Accordingly, even if the relative positions of the first relaying flexible flat cable CR_FFC1 and the second relaying flexible flat cable CR_FFC2 become displaced for some reason, an excellent shielding effect can be achieved for the transmission lines in which voltages vary.

It should be noted that the transmission lines of the latch signal LAT and the change signal CH may also be set in opposition to the ground line group as transmission lines in which voltages vary.

(2) Furthermore, the number of the ground lines GND lined up continuously in the ground line group is at least three lines. By doing this, an arrangement can be achieved in which a ground line group constituted by three ground lines GND are caused to be in opposition to a single transmission line in which voltage varies. Accordingly, even if the relative positions of the first relaying flexible flat cable CR_FFC1 and the second relaying flexible flat cable CR_FFC2 become displaced within a range equivalent to a single transmission line, the transmission line, in which voltage varies, is positioned at a position in opposition to the region that covers the ground line group. Thus, even if the relative positions of the first relaying flexible flat cable CR_FFC1 and the second relaying flexible flat cable CR_FFC2 become displaced for some reason within a range equivalent to a single transmission line, an excellent shielding effect can be achieved for the transmission line in which voltage varies.

(3) Furthermore, the number of the ground lines GND lined up continuously in the ground line group is at least two lines more than the number of the transmission lines in which voltages vary.

By doing this, an arrangement can be achieved in which a ground line group constituted by ground lines GND of two more lines than the plurality of transmission lines is caused to be in opposition to the plurality of transmission lines, in which voltages vary. Accordingly, even if the relative positions of the first relaying flexible flat cable CR_FFC1 and the second relaying flexible flat cable CR_FFC2 become displaced within a range equivalent to a single transmission line, the transmission lines, in which voltages vary, are positioned so as to be in opposition to the region that is covered by the ground line group. Thus, even if the relative positions of the first relaying flexible flat cable CR_FFC1 and the second relaying flexible flat cable CR_FFC2 become displaced for some reason within a range equivalent to a single transmission line, an excellent shielding effect can be achieved for the transmission line in which voltage varies.

(4) Furthermore, in the second relaying flexible flat cable CR_FFC2 (or the second head-connecting flexible flat cable HD_FFC2), the ground lines GND are further arranged so as to sandwich the transmission lines in which voltages vary.

In this way, the ground lines are arranged so as to sandwich the transmission lines in which voltages vary, and therefore a better shielding effect can be achieved for the transmission lines in which voltages vary.

(5) Furthermore, a third relaying flexible flat cable CR_FFC3 is further provided in opposition to a reverse side of a side of the second relaying flexible flat cable CR_FFC2 in opposition to the first relaying flexible flat cable CR_FFC1 and in which a plurality of transmission lines are lined up in the predetermined direction, this being a third relaying flexible flat cable CR_FFC3 in which transmission lines, in which voltages vary, are arranged so as to be in opposition to the region that covers the ground line group.

By doing this, the ground line group of the first relaying flexible flat cable CR_FFC1 and the ground line group of the third relaying flexible flat cable CR_FFC3 are arranged so as to sandwich the transmission lines of the second relaying flexible flat cable CR_FFC2 in which voltages vary, and therefore a better shielding effect can be achieved for the transmission lines in which voltages vary. Furthermore, in a case where three or more flexible flat cables are superimposed on each other, the ground lines can be arranged very efficiently while achieving an excellent shielding effect for the transmission lines in which voltages vary.

(6) Furthermore, the transmission lines, in which voltages vary, transmit differential signals that are constituted by a signal to be sent and an inverted signal of the signal to be sent.

By doing this, even in a case when noise is introduced while signals are be transmitted via the flexible flat cable, the noise can be negated by using the differential signals, which enables the original signal that was intended to be sent to be easily restored.

(7) Furthermore, the transmission line in which voltage varies transmits the clock signal SCK for transmission.

The clock signal SCK for transmission is one of the fastest transmitted signals of the pulse signals used in ink ejection control of the printer 1. Accordingly, it is prone to becoming a noise source for the other signals. Furthermore, since it is a high frequency signal, it is easily affected by noise from other signals. However, since shielding is implemented for the transmission lines for the clock signal SCK for transmission as described above, the effect of noise of other equipment can be reduced. Furthermore, the clock signal SCK for transmission itself becomes less prone to effects from other signals, which enables an accurate clock signal SCK for transmission to be transmitted.

(8) Furthermore, the head 40 for ejecting ink droplets is further provided, wherein the transmission lines in which voltages vary transmit drive signals COM to be applied to the head 40 for causing the liquid droplets to be ejected.

The drive signal COM is a signal that is generated by current amplification in the drive signal generating circuit 70 and has a large amount of electric current compared to other signals that travel in the flexible flat cable. Accordingly, although it is prone to affect as noise the other signals traveling in the flexible flat cable, shielding can be implemented as described above for the transmission lines in which voltages vary, and therefore the effect of noise on other signals can be reduced. Furthermore, shielding is implemented for the transmission lines for sending the drive signals COM and therefore the drive signal COM itself becomes less prone to effects from other signals, which enables accurate drive signals to be transmitted.

(9) Furthermore, the head 40 for ejecting ink droplets is further provided, wherein the transmission lines in which voltages vary transmit the pixel data SI as control signals for controlling whether or not the ink droplets are to be ejected.

The pixel data SI is important data for indicating what size of dot is to be formed in the pixel. Supposing the pixel data SI were to be adversely affected by noise from other signals, it would not be possible to form a proper image. However, here shielding is implemented for the transmission lines for the pixel data SI as the transmission lines in which voltages vary, and therefore the effect of noise from other signals can be reduced.

(10) Furthermore, the main substrate Base_M, which connects one end of the first relaying flexible flat cable CR_FFC1 and one end of the second relaying flexible flat cable CR_FFC2, and the relay substrate Base_I, which connects the other end of the first relaying flexible flat cable CR_FFC1 and the other end of the second relaying flexible flat cable CR_FFC2, are substrates that move relative to each other.

In a case where the substrates move relative to each other in this manner, the superimposed flexible flat cables sometimes become displaced in the direction in which their transmission lines are lined up. In a case such as this, the transmission lines in which voltages vary can be positioned so as to be in opposition to the region that covers the ground line group.

(11) Furthermore, the connecting section of the relay substrate Base_I, which connects one end of the first head-connecting flexible flat cable HD_FFC1 and one end of the second head-connecting flexible flat cable HD_FFC2, and the connecting section of the head controller HC, which connects the other end of the first head-connecting flexible flat cable HD_FFC1 and the other end of the second head-connecting flexible flat cable HD_FFC2, are connecting sections that do not move relative to each other.

Even in a case where the substrates do not move relative to each other in this manner, displacement is possible in the direction in which their transmission lines are lined up in a process of assembling the printer. In a case such as this, the transmission line, in which voltage varies, can be positioned so as to be in opposition to the region that covers the ground line group.

(12) Furthermore, it goes without saying that superimposed flexible flat cables (signal transmission channels), in which the ground lines and the transmission line, in which voltage varies, are arranged as described above, can also be used in other applications.

Although the preferred embodiment of the present invention has been described in detail, it should be understood that various changes, substitutions and alterations can be made therein without departing from spirit and scope of the inventions as defined by the appended claims.

What is claimed is:

1. A signal transmission channel, comprising:

a first cable including a ground line group in which ground lines are lined up continuously and occupies a region of the first cable; and a second cable including a transmission line for transmitting a differential signal, the transmission line being arranged so as to superimpose the region occupied by the ground line group.

2. The signal transmission channel of claim 1, wherein the second cable further comprising a second transmission line;

wherein the transmission line transmits a positive differential signal of a signal intended for transmission; the second transmission line transmits a negative differential signal of the signal intended for transmission; the transmission line and the second transmission line being arranged in positions close to each other; and the signal intended for transmission being restored from the positive differential signal and the negative differential signal after they have been transmitted.

3. A liquid ejecting apparatus, comprising:

a head that ejects a liquid;

a plurality of cables that transmit signals to the head;

wherein the plurality of cables comprises:

a first cable that includes a first plurality of transmission lines, the first plurality of transmission lines including a ground line group in which ground lines are lined up continuously and occupy a first region; and a second cable that is arranged so as to superimpose the first cable and includes a second plurality of transmission lines being arranged in a second region so as to superimpose the first region; and wherein the second plurality of transmission lines include:

a first transmission line for transmitting a positive differential signal of a signal intended for transmission; and a second transmission line for transmitting a negative differential signal of the signal intended for transmission;

the first and second transmission lines being arranged in positions close to each other; and the signal intended for transmission being restored from the positive differential signal and the negative differential signal after they have been transmitted.

4. A liquid ejecting apparatus according to claim 3, wherein the ground line group comprises at least three ground lines.

5. A liquid ejecting apparatus according to claim 3, wherein the ground line group comprises at least two ground lines more than a number of the second plurality of transmission lines.

6. A liquid ejecting apparatus according to claim 3, wherein in the second cable, ground lines are further arranged so as to sandwich the second plurality of transmission lines.

7. A liquid ejecting apparatus according to claim 3, further comprising a third cable that superimposes a side of the second cable in opposition to the first cable, the third cable includes a ground line group lined up to occupy a third region, the second plurality of transmission lines being arranged so as to superimpose the third region.

8. A liquid ejecting apparatus according to any of claims 3-7, wherein the second plurality of transmission lines transmit differential signals that includes a signal to be sent and an inverted signal of the signal to be sent.

9. A liquid ejecting apparatus according to claim 3, wherein one of the second plurality of transmission lines transmits a clock signal.

10. A liquid ejecting apparatus according to claim 3, wherein one of the second plurality of transmission lines transmits drive signals to be applied to the head for causing the liquid to be ejected.

11. A liquid ejecting apparatus according to claim 3, wherein one of the second plurality of transmission lines transmits control signals for controlling whether or not to eject the liquid.

12. A liquid ejecting apparatus according to claim 3, wherein a first member, which connects one end of the first cable and one end of the second cable, and a second member, which connects another end of the first cable and another end of the second cable, are members that move relative to each other.

13. A liquid ejecting apparatus according to claim 3, wherein a first connecting section, which connects one end of the first cable and one end of the second cable, and a second connecting section, which connects another end of the first cable and another end of the second cable, are connecting sections that do not move relative to each other.

* * * * *